US008247714B2

(12) United States Patent
Tsai

(10) Patent No.: US 8,247,714 B2
(45) Date of Patent: Aug. 21, 2012

(54) BACK LIGHTED MEMBRANE KEYBOARD WITH COMPONENTS BEING SECURED TOGETHER BY SUBJECTING TO ULTRASONIC WELDING

(75) Inventor: Huo-Lu Tsai, Taichung Hsien (TW)

(73) Assignee: Sunrex Technology Corp, Taichung (TW)

( * ) Notice: Subject to any disclaimer, the term of this patent is extended or adjusted under 35 U.S.C. 154(b) by 262 days.

(21) Appl. No.: 12/796,287

(22) Filed: Jun. 8, 2010

(65) Prior Publication Data

US 2011/0297523 A1 Dec. 8, 2011

(51) Int. Cl.
*H01H 13/70* (2006.01)

(52) U.S. Cl. ..... 200/5 A; 29/622; 200/517; 200/314; 200/344

(58) Field of Classification Search ..... 200/58, 200/517, 293, 310–317, 341–345; 400/490–496; 341/22; 345/168–170; 29/622
See application file for complete search history.

(56) References Cited

U.S. PATENT DOCUMENTS

| | | | | |
|---|---|---|---|---|
| 3,860,771 | A * | 1/1975 | Lynn et al. | 200/5 A |
| 4,028,509 | A * | 6/1977 | Zurcher | 200/5 A |
| 4,349,705 | A * | 9/1982 | Kuhfus | 379/361 |
| 4,430,531 | A * | 2/1984 | Wright | 200/5 A |
| 6,130,388 | A * | 10/2000 | Nishijima | 200/293 |
| 6,971,807 | B2 * | 12/2005 | Tsai et al. | 400/472 |
| 7,525,056 | B2 * | 4/2009 | Chiba et al. | 200/314 |
| 7,660,104 | B2 * | 2/2010 | Ligtenberg | 361/679.08 |
| 2007/0144873 | A1 * | 6/2007 | Chen | 200/5 A |
| 2009/0133999 | A1 * | 5/2009 | Yamada et al. | 200/345 |
| 2011/0155551 | A1 * | 6/2011 | Yamada | 200/5 A |
| 2012/0048700 | A1 * | 3/2012 | Liu | 200/5 A |

* cited by examiner

*Primary Examiner* — Michael Friedhofer

(57) ABSTRACT

A back lighted membrane keyboard includes a key housing, a membrane, a key support plate, a membrane circuit board, an insulative plate, a light guide membrane plate, and a base plate. The key housing, the membrane, the key support plate, the membrane circuit board, the insulative plate, and the light guide membrane plate are aligned by inserting stems thereinto. Eventually, these components are subjected to ultrasonic welding to be bound together.

6 Claims, 6 Drawing Sheets

BACK LIGHTED MEMBRANE KEYBOARD WITH COMPONENTS BEING SECURED TOGETHER BY SUBJECTING TO ULTRASONIC WELDING

BACKGROUND OF THE INVENTION

1. Field of Invention

The invention relates to membrane keyboards and more particularly to a back lighted membrane keyboard having components being secured together by subjecting to ultrasonic welding.

2. Description of Related Art

Laptops are widely used by people throughout the world due to portability, word processing and other capabilities common to desktop computers, and Internet access. Membrane keyboards are typically employed by laptops. Membrane keyboards are advantageous for being thin, lightweight, and compact. However, most types of laptops are limited to operate in a bright environment only since there is no backlight device provided.

For overcoming above drawback, many prior keyboard/keypad patents with backlight arrangement are disclosed. For example, Taiwanese Utility Model Patent No. M306,689 discloses a keyboard with backlight arrangement. Also, in my earlier U.S. Pat. No. 7,608,792, an improved membrane keyboard/keypad with arrangement for uniformly lighting keys from background is disclosed.

The U.S. Patent has been successfully used in a commercial application. However, in practice it is found that components of the U.S. Patent are not always aligned since they are assembled by adhesive. This adversely lowers the yield. Thus, continuing improvements of membrane keyboards for laptop are constantly sought by the present inventor.

SUMMARY OF THE INVENTION

It is therefore one object of the invention to provide a membrane keyboard comprising a plastic key housing comprising a plurality of first openings and a plurality of downward extending stems; a membrane disposed below the key housing and comprising a plurality of second openings and a plurality of dome-shaped insulative elastic members each including a central receptacle and a downward extending peg aligned with the receptacle; a plurality of transparent keys each disposed on the first opening and having a bottom key shaft fitted in the receptacle; a key support plate disposed below the membrane and comprising a plurality of third openings; a plurality of scissor-shaped structures each put on and retained by the elastic member, each scissor-shaped structure having a top secured to the key and a bottom secured to the key support plate; a membrane circuit board disposed below the key support plate and comprising a plurality of spaced bottom LEDs (light-emitting diodes), a plurality of fourth openings, and a plurality of first contacts; an insulative plate disposed below the membrane circuit board and comprising a plurality of fifth openings and a plurality of circular holes each disposed below the first contact; a light guide membrane plate disposed below the insulative plate and comprising a plurality of second contacts each spaced apart from the first contact, and a plurality of top engagement points; and a base plate disposed below the light guide membrane plate, wherein the stem inserts through the second, third, fourth, and fifth openings to engage with the engagement point so that the key housing, the membrane, the key support plate, the membrane circuit board, the insulative plate, and the light guide membrane plate are aligned; and wherein the key housing, the membrane, the key support plate, the membrane circuit board, the insulative plate, and the light guide membrane plate are subsequently subjected to ultrasonic welding to be bound together.

The above and other objects, features and advantages of the invention will become apparent from the following detailed description taken with the accompanying drawings.

DETAILED DESCRIPTION OF THE INVENTION

Figure 1:
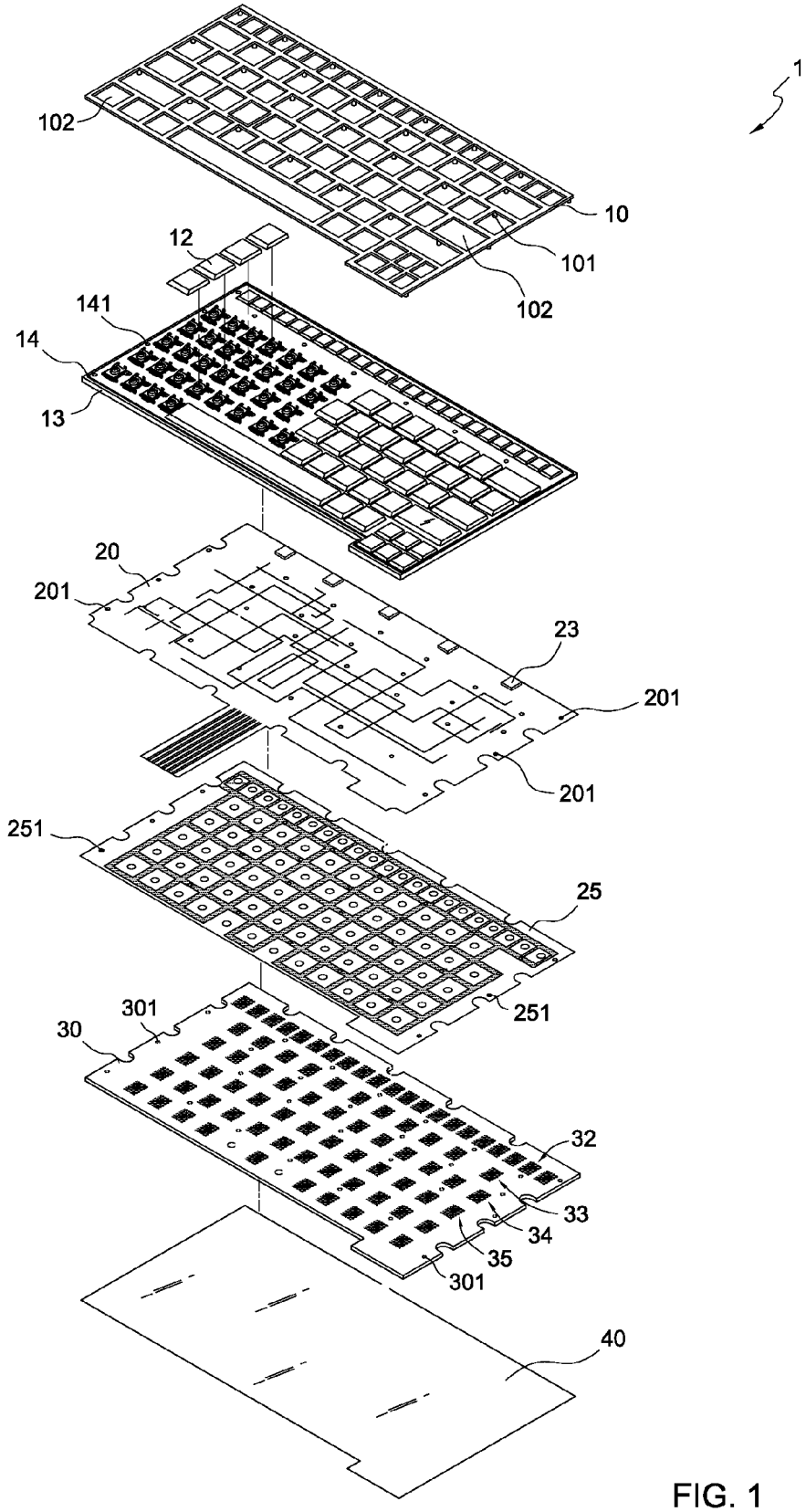
FIG. 1 is an exploded view of a preferred embodiment of membrane keyboard for laptop according to the invention.
Figure 2:
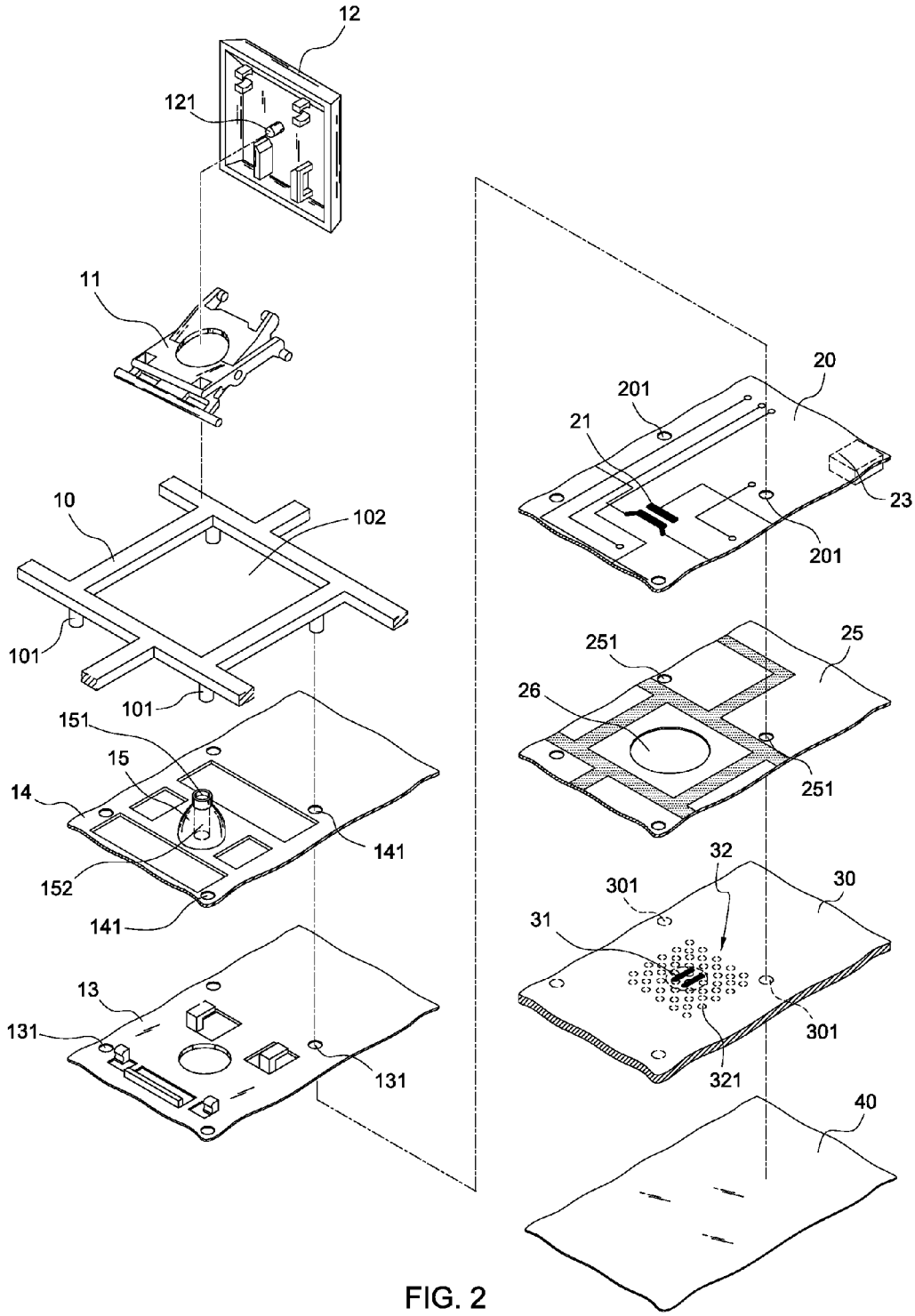
FIG. 2 is a fragmentary view of FIG. 1 depicting details of a single key construction.
Figure 3:
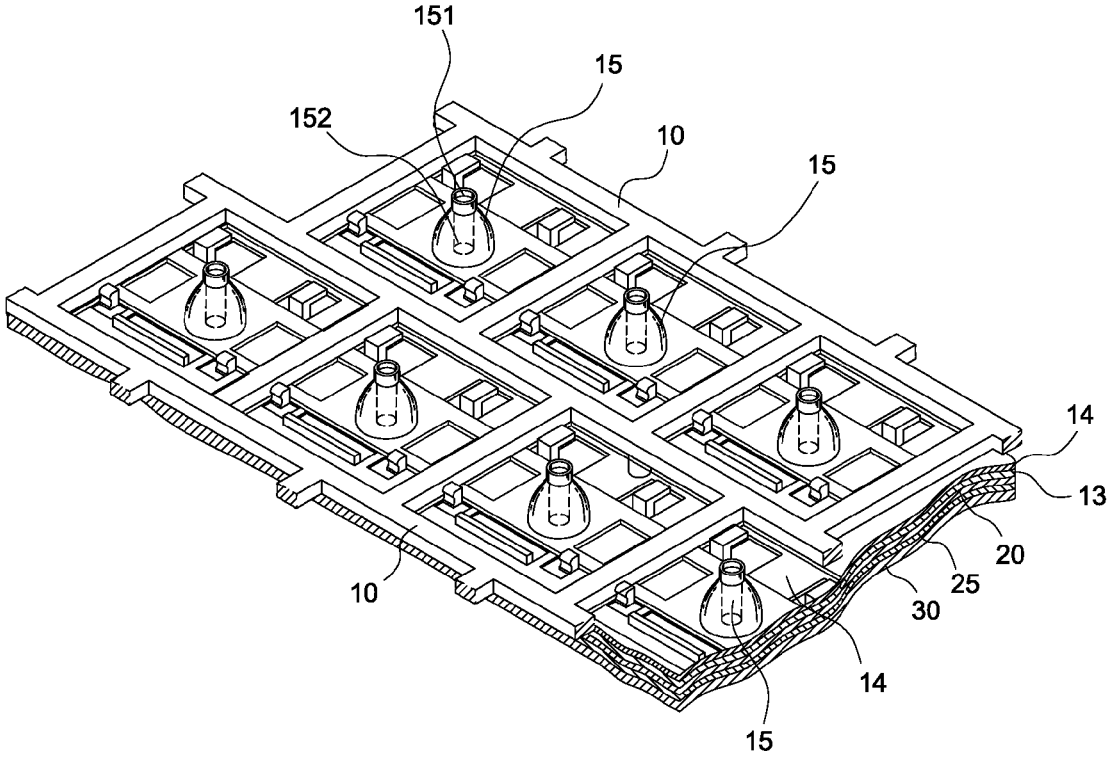
FIG. 3 is a perspective view of a number of adjacent units each comprising some assembled components of FIG. 2.
Figure 4:
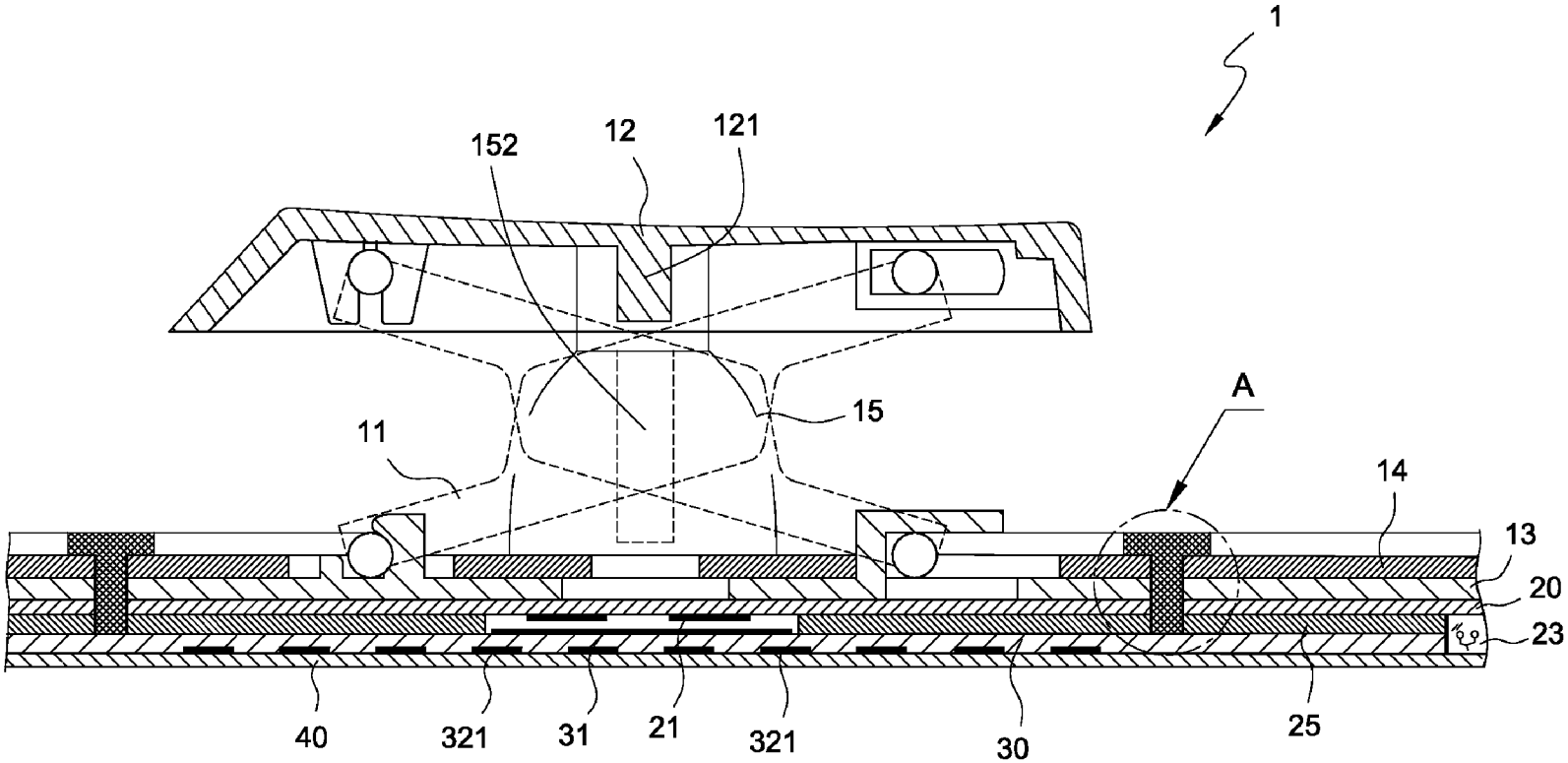
FIG. 4 is a longitudinal sectional view of the assembled components of FIG. 1.
Figure 4A:
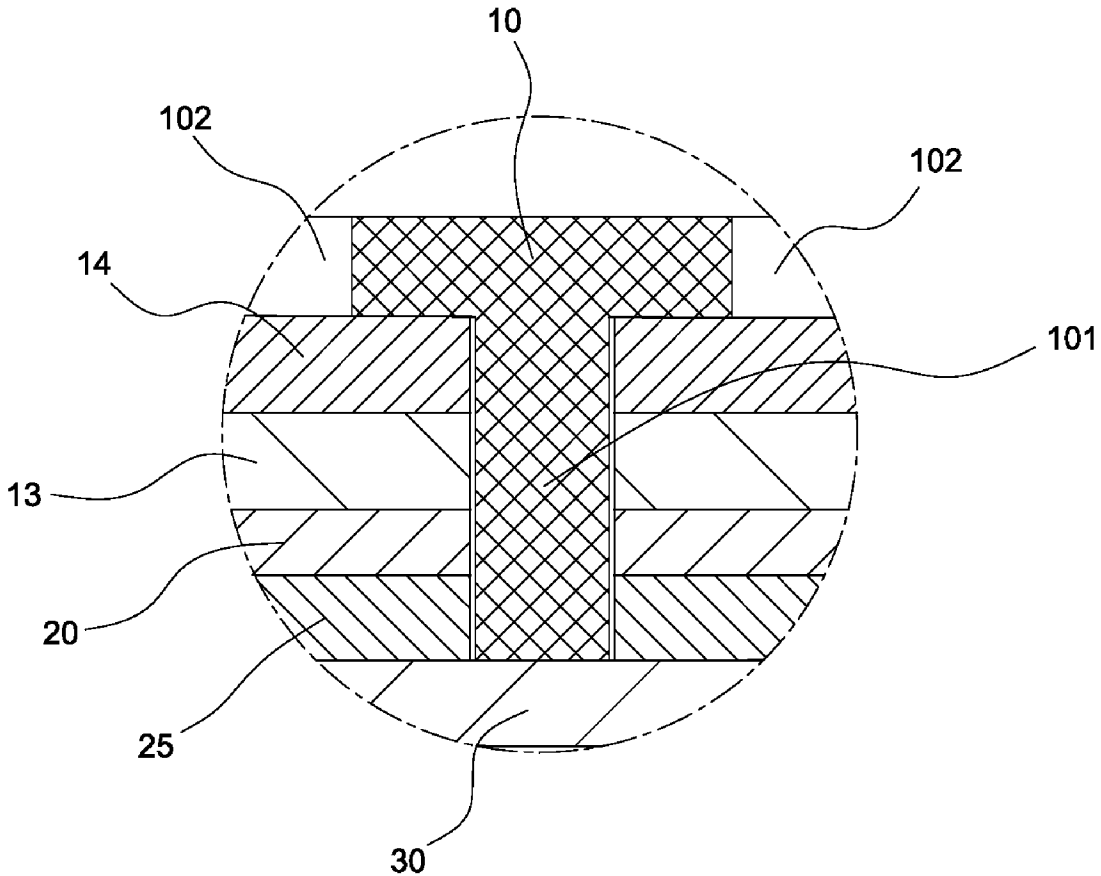
FIG. 4A is a detailed view of the area in circle A in FIG. 4.
Figure 5:
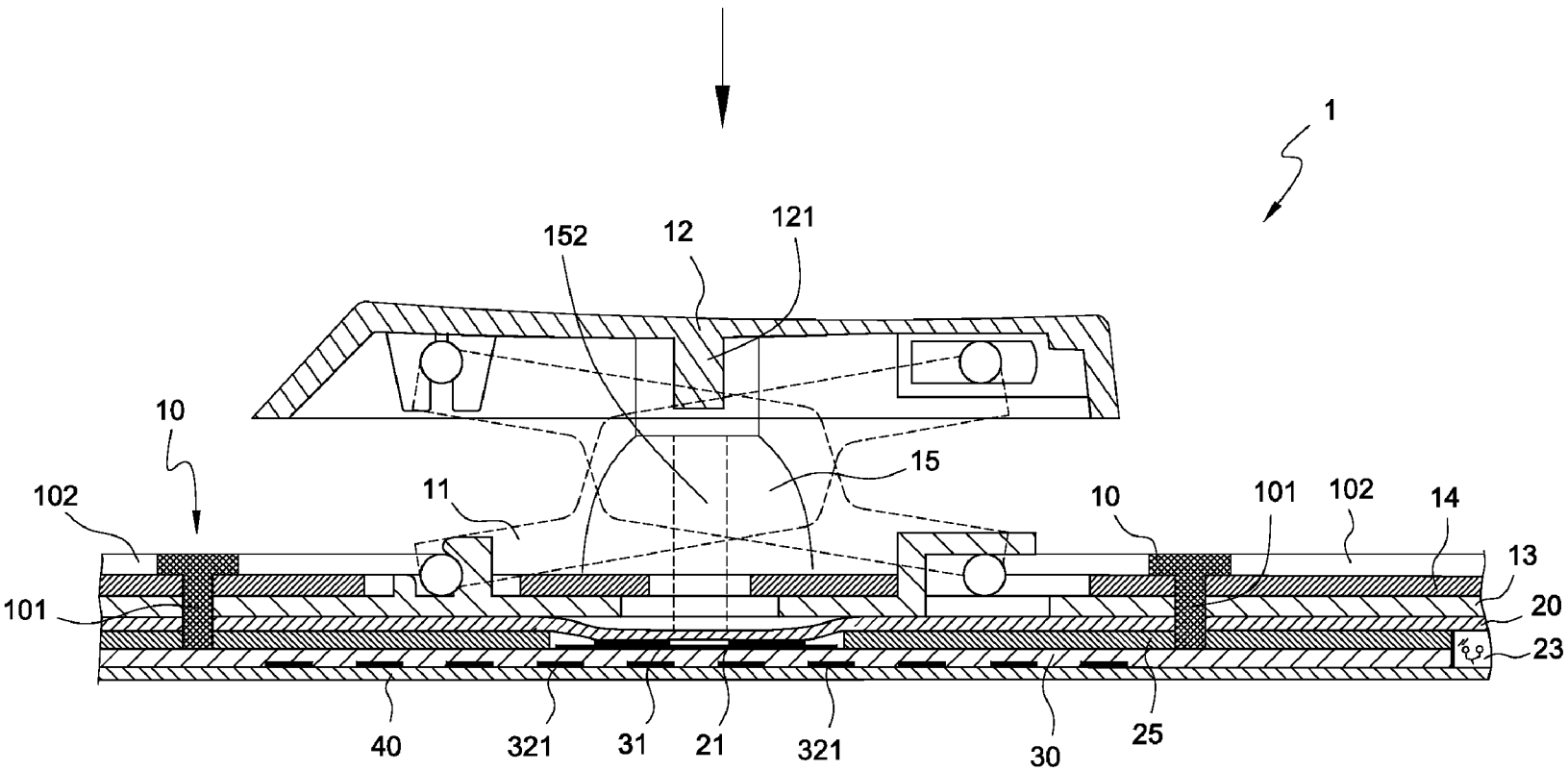
FIG. 5 is a view similar to FIG. 4 where a key press operation is shown.

Referring to FIGS. 1 to 5, a membrane keyboard 1 according to a preferred embodiment of the invention is shown. The membrane keyboard 1 is for laptop and comprises the following components, substantially from top to bottom, as discussed in detail below.

A substantially rectangular key housing 10 made of plastics comprises a plurality of rectangular openings 102 and a plurality of downward extending stems 101.

A substantially rectangular membrane 14 including a plurality of openings 141, a plurality of openings (not numbered), and a plurality of dome-shaped elastic members 15 formed of a flexible insulative material (e.g., elastomeric material). The elastic member 15 comprises a central receptacle 151 and a downward extending peg 152 aligned with the receptacle 151.

A plurality of transparent keys 12 each is disposed on the opening 102 and has a square top surface. On the bottom of the key 12 there are provided a central key shaft 121 extending downward to be disposed in the receptacle 151, and a retaining structure (not numbered).

A substantially rectangular key support plate 13 comprises a plurality of openings 131 and a fastening structure (not numbered).

The key housing 10 is disposed on the membrane 14 which is in turn disposed on the key support plate 13. Also, the stem 101 inserts through the openings 141 and 131.

A plurality of scissor-shaped structures 11 each has a cross-section of "X" and a central opening (not numbered). The scissor-shaped structure 11 is put on and retained by the elastic member 15 after inserting through the opening 102 and the opening of the membrane 14 to be fastened by the fastening structure of the key support plate 13. Further, the key shaft 121 of each key 12 is inserted through the opening of the scissor-shaped structure 11 to complimentarily dispose in the receptacle 151 with the retaining structure secured to the scissor-shaped structure 11.

A membrane circuit board 20 is disposed below the key support plate 13 and comprises circuitry, a plurality of spaced bottom LEDs (light-emitting diodes) 23, the LEDs 23 being electrically connected to the circuitry, a plurality of openings 201, and a plurality of contacts 21.

An insulative plate 25 is disposed below the membrane circuit board 20 and comprises a plurality of openings 251 and a plurality of circular holes 26 each larger than the opening 251, the circular hole 26 being disposed below the contact 21.

A light guide membrane plate 30 is disposed below the insulative plate 25 and is formed of transparent silicone rubber. The light guide membrane plate 30 comprises a plurality of different light diffusing areas 32, 33, 34, and 35 on the bottom. Each light diffusing area 32, 33, 34, or 35 is disposed a predetermined short distance right below a corresponding one of the keys 12. The number of the light diffusing areas 32, 33, 34, and 35 is the same as that of the keys 12. Further, the light diffusing areas 32, 33, 34, and 35 and the keys 12 are substantially rectangular. Furthermore, each of the light diffusing areas 22, 23, 24, and 25 and its corresponding key 12 substantially have the same area. Each light diffusing area 32, 33, 34, or 35 includes a plurality of cavities (only cavities 321 being shown). The light guide membrane plate 30 further includes a plurality of contact 31 and a plurality of top engagement points 301. A substantially rectangular base plate 40 is provided below the light guide membrane plate 30.

The membrane circuit board 20, the insulative plate 25, the light guide membrane plate 30, and the base plate 40 are stacked with the openings 131, 201, and 251 being aligned with the engagement point 301. Therefore the stem 101 can be further inserted through the openings 131, 201, and 251 to contact the engagement point 301. This is an alignment step. Moreover, the contact 21, the circular hole 26, and the contact 31 are aligned and together they are aligned with the elastic member 15 and the scissor-shaped structure 11 thereabove. The LEDs 23 are disposed on the base plate 40. The cavities including cavities 321 are different in terms of depth, size, and density corresponding to different distances from the LEDs 23. This can ensure that light emitted by the LEDs 23 is substantially uniformly directed upward toward the keys 12 through the light diffusing areas 32, 33, 34, and 35. Hence, the keys 12 are lit uniformly when the laptop is turned on. The elastic members 15 are secured onto the light diffusing areas 22, 23, 24, and 25 respectively. Finally, as the subject of the invention, above aligned components are subjected to ultrasonic welding to be bound together.

In use, a user may press the key 12 to push down the key shaft 121 to pivot the scissor-shaped structure 11 so that the elastic member 15 can be elastically downward compressed by both the key 12 and the pivoting scissor-shaped structure 11. Further, a portion of the membrane circuit board 20 below the elastic member 5 is depressed by the peg 152. The depression can cause the contact 21 to engage with the contact 31 so as to electrically connect them together. As a result, a key switch is "closed" and the depressed key 12 is activated. It is understood that a release of the key 12 will elastically return the key 12 to its rest position.

While the invention has been described in terms of preferred embodiments, those skilled in the art will recognize that the invention can be practiced with modifications within the spirit and scope of the appended claims.

What is claimed is:

1. A membrane keyboard, comprising:

a plastic key housing comprising a plurality of first openings and a plurality of downward extending stems;

a membrane disposed below the key housing and comprising a plurality of second openings and a plurality of dome-shaped insulative elastic members each including a central receptacle and a downward extending peg aligned with the receptacle;

a plurality of transparent keys each disposed on the first opening and having a bottom key shaft fitted in the receptacle;

a key support plate disposed below the membrane and comprising a plurality of third openings;

a plurality of scissor-shaped structures each put on and retained by the elastic member, each scissor-shaped structure having a top secured to the key and a bottom secured to the key support plate;

a membrane circuit board disposed below the key support plate and comprising a plurality of spaced bottom LEDs (light-emitting diodes), a plurality of fourth openings, and a plurality of first contacts;

an insulative plate disposed below the membrane circuit board and comprising a plurality of fifth openings and a plurality of circular holes each disposed below the first contact;

a light guide membrane plate disposed below the insulative plate and comprising a plurality of second contacts each spaced apart from the first contact, and a plurality of top engagement points; and a base plate disposed below the light guide membrane plate, wherein the stem inserts through the second, third, fourth, and fifth openings to engage with the engagement point so that the key housing, the membrane, the key support plate, the membrane circuit board, the insulative plate, and the light guide membrane plate are aligned; and wherein the key housing, the membrane, the key support plate, the membrane circuit board, the insulative plate, and the light guide membrane plate are subsequently subjected to ultrasonic welding to be bound together.

2. The membrane keyboard of claim 1, wherein each key has a square top surface, and wherein each scissor-shaped structure pivots in response to pressing from above.

3. The membrane keyboard of claim 1, wherein a pressing of the key pushes down the key shaft and pivots the scissor-shaped structure so as to compress the elastic member being by both the key and the pivoting scissor-shaped structure, a portion of the membrane circuit board is depressed by the elastic member, and the depression portion of the membrane circuit board causes the first contact to electrically connect to the second contact so that a key press is carried out.

4. The membrane keyboard of claim 3, wherein the first contact is adapted to engage with the second contact in response to the key press.

5. The membrane keyboard of claim 1, wherein the light guide membrane plate further comprises a plurality of different light diffusing areas on bottom, each light diffusing area being disposed a predetermined distance below a corresponding one of the keys, each light diffusing area including a plurality of cavities being different in terms of depth, size, and density corresponding to different distances from the LEDs so that light emitted by the LEDs is substantially uniformly directed upward toward the keys for illumination through the light diffusing areas.

6. The membrane keyboard of claim 1, wherein the base plate is adapted to support the key housing, the membrane, the keys, the support plate, the scissor-shaped structures, the membrane circuit board, the insulative plate, and the light guide membrane plate.

* * * * *